US005483782A

United States Patent [19]

Hall

[11] Patent Number: 5,483,782

[45] Date of Patent: Jan. 16, 1996

[54] LOAD BEARING BEAM HAVING CORROSION RESISTANT CLADDING

[76] Inventor: Donald M. Hall, P.O. Box 1247, Progress St., Kingston, N.Y. 12401

[21] Appl. No.: 176,986

[22] Filed: Jan. 3, 1994

[51] Int. Cl.[6] ..... E04C 3/30

[52] U.S. Cl. ..... 52/730.1; 52/731.7; 52/731.3

[58] Field of Search ..... 52/730.1, 730.4, 52/731.2, 731.3, 731.7, 311.1, 729

[56] References Cited

U.S. PATENT DOCUMENTS

| | | | |
|---|---|---|---|
| 183,160 | 10/1876 | Haughian | 52/729 X |
| 1,141,067 | 5/1915 | Lloyd . | |
| 1,833,174 | 11/1931 | Horris | 52/731.7 |
| 1,906,683 | 5/1933 | Weiskopf et al. | 52/729 |
| 1,954,954 | 4/1934 | Shugart | 52/731.7 X |
| 2,068,583 | 1/1937 | Westlund et al. . | |
| 3,319,389 | 5/1967 | Levine | 52/731.7 X |
| 3,753,326 | 8/1973 | Kaufman, Sr. | 52/729 X |
| 3,783,498 | 1/1974 | Moyer et al. . | |
| 4,081,941 | 4/1978 | Van Ausdall | 52/729 X |
| 4,206,578 | 6/1980 | Mieyal | 52/730.1 |
| 4,489,529 | 12/1984 | Ollinger et al. | 52/731.7 |
| 4,713,919 | 12/1987 | Platt . | |
| 4,937,998 | 6/1990 | Goldberg | 52/729 |
| 5,308,675 | 5/1994 | Crane et al. | 52/729 X |

*Primary Examiner*—Wynn E. Wood
*Attorney, Agent, or Firm*—Shlesinger Arkwright & Garvey

[57] ABSTRACT

Beam includes a V-shaped or T-shaped main load-bearing member, having an apex and a mouth spaced from the apex. A cladding member is disposed on the V-shaped main load-bearing member, covers the mouth thereof, and defines a support surface. In a preferred embodiment, the cladding member is stainless steel and the V-shaped main load-bearing member is galvanized steel.

20 Claims, 2 Drawing Sheets

LOAD BEARING BEAM HAVING CORROSION RESISTANT CLADDING

FIELD OF THE INVENTION

This invention relates to a support member, such as a load bearing beam. It should be understood that the inventive load bearing member can be used as a column, a cantilever, and as many other structural components of a larger system.

BACKGROUND OF THE INVENTION

Support members, such as beams and the like, are known that have multiple layers and include two or more types of material.

However, there is still a need for a structural member, such as a load bearing beam, which overcomes the drawbacks of conventional supports that are relatively expensive, complicated to manufacture, fail to optimize the use of materials by fully exploiting the physical characteristics of the different materials, and which are unwieldy, bulky, difficult to use, and unhygienic.

Accordingly, there is a need for a support member which overcomes these above-mentioned drawbacks.

U.S. Pat. No. 4,713,919 to Platt discloses a laser welded ceiling grid member including an inverted T-shaped beam which includes a main part having a lower portion 27, and outwardly extending flanges 29 and 31 covered by a galvanized coating 15. A cap 35 surrounds the Platt flanges 29 and 31. The cap 35 covers a weld 33 because application of weld 33 has destroyed the Platt galvanized coating 15 in the vicinity of weld 33.

U.S. Pat. No. 2,068,583 to Westlund et al. discloses a support and method of making the same, which support includes a base metal central portion, such as strip 26 (FIG. 6) that is surrounded by a cover portion 15, as shown in FIG. 7. Westlund discloses that a suitable material for the base metal is cold-rolled steel, while a suitable material for the cover is stainless steel.

U.S. Pat. No. 3,462,818 to Moon discloses a method of making a hollow metal leg including a stainless steel strip bent into a first C-shaped channel, a second C-shaped channel disposed therein and opening in the opposite direction of the first C-shaped channel, and a decorative strip slidably retained between portions of the first and second C-shaped channels.

U.S. Pat. No. 3,783,498 to Moyer et al. describes a method of constructing a hollow beam having opposed outer surfaces strengthened by added on steel strips differing in thickness from the remainder of the hollow beam and which opposed ends are intended to be the upper and lower surfaces of the beam.

U.S. Pat. No. 1,141,067 to Lloyd discloses a reinforced tubing which comprises a substantially cylindrical seamless tubing 1 having a plurality of less expensive formed inner pieces of tubing having longitudinal seams.

The term "beam" as used throughout the description is for convenience only, given that all types of support members, columns, cantilevers, structural members, and the like are intended to be included within the scope of the invention. Likewise, the terms V-shaped and T-shaped beams are general terms, as the appearance of such beams depends on the size of the respective included angles and the particular materials and structure of the beams according to the invention.

OBJECTS AND SUMMARY OF THE INVENTION

It is a first object of the invention to provide a beam which overcomes the drawbacks of existing devices.

Another object of the invention is to provide a beam which is simpler and more economical to form than existing devices.

Yet another object of the invention is to provide a beam which may be used as a support member.

A still further object of the invention is to provide a beam having at least one surface which is easier to clean, and hence, more hygienic than known supports.

Another object of the invention is to provide a beam which can be fabricated without the use of welding.

It is a yet still further object of the invention to provide a beam which fully exploits the properties and material strength of both the clad material and the cladding material.

A further object of the invention is to provide a substantially T-shaped beam having all the above- and below-described features.

A further object of the invention is to provide a beam which can be constructed with few or no welds between cooperating pieces of different materials.

In summary, therefore, the invention is directed to a beam including a substantially V-shaped main load-bearing member, an apex defined by the V-shaped load-bearing member, a mouth defined by the V-shaped load-bearing member and spaced opposed from the apex, and a cladding member disposed on said V-shaped load-bearing member, the cladding member defining a support surface and substantially covering the mouth.

The invention will be further described with reference to the following drawings.

DETAILED DESCRIPTION OF THE INVENTION

Figure 1:
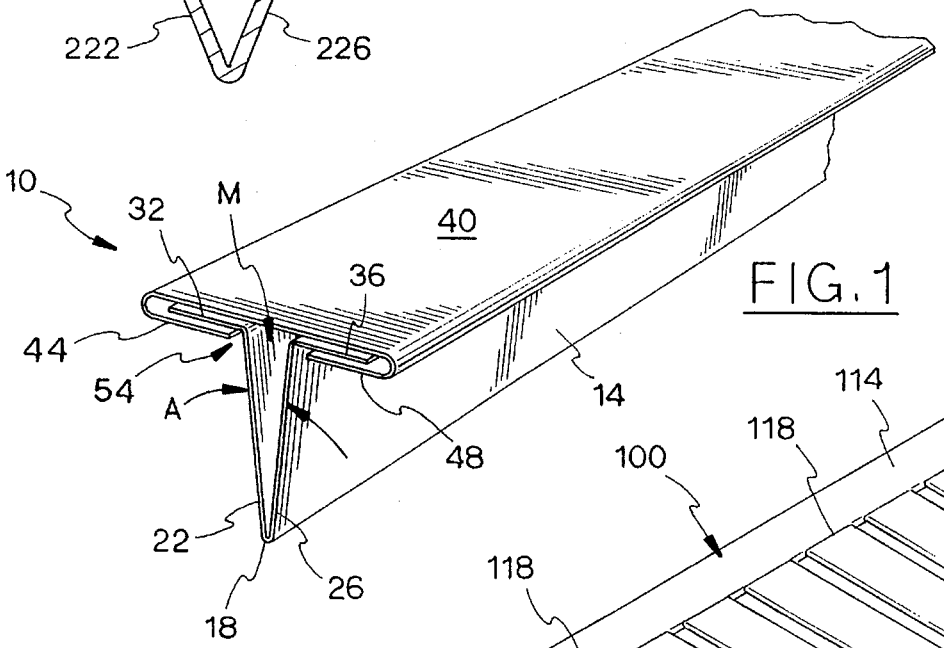
FIG. 1 is a perspective view of a load-bearing beam according to a first preferred embodiment of the invention.

FIG. 1 illustrates a first preferred embodiment of a load-bearing beam 10 according to the invention.

Beam 10 includes a main load-bearing member 14 having an apex 18 defined by a left leg 22 and an opposed right leg 26. An angle A is defined between left leg 22 and right leg 26. A leftwardly extending horizontal flange 32 projects outwardly away from left leg 22 and a similar, rightwardly extending horizontal flange 36 projects away from right leg 26.

A mouth M includes an opening located distant from apex 18 and in the vicinity of the junctions between left horizontal flange 32 and left leg 22, as well as right horizontal flange 36 and right leg 26.

A cladding member 40 defines a support surface and includes a left inwardly extending arm 44 which envelops left horizontal flange 32. An analogous right inwardly extending arm 48 envelops right horizontal flange 36 of main load-bearing 14.

An optional weld 54, or series of welds, positively joins cladding 240 to main load-bearing member 214.

Figure 2:
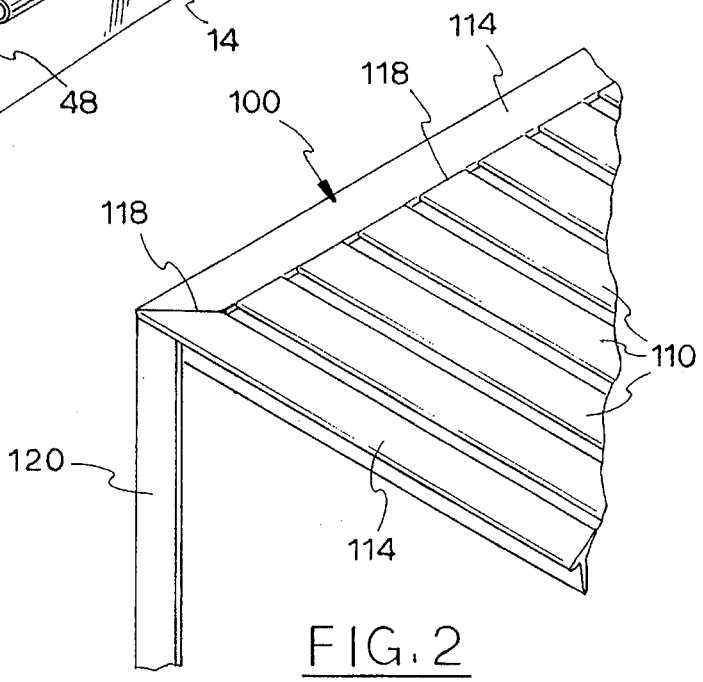
FIG. 2 is a partial, somewhat schematic top perspective view of a portion of a support device, such as a table, incorporating the load-bearing beam according to the first preferred embodiment of the invention shown in FIG. 1.

Turning to FIG. 2, a table 100 is shown that incorporates a plurality of lateral supports 110, which preferably comprise beams 10 as illustrated in FIG. 1.

Table 100 further includes peripheral supports 114 which may likewise be made of beams 10 as shown in the embodiment of FIG. 1. Welds 118 tie lateral supports 110 to peripheral supports 114 at free edges thereof. A conventional leg 120 extends downwardly away from peripheral supports 114 for establishing table 100 as a raised support surface.

Figure 3:
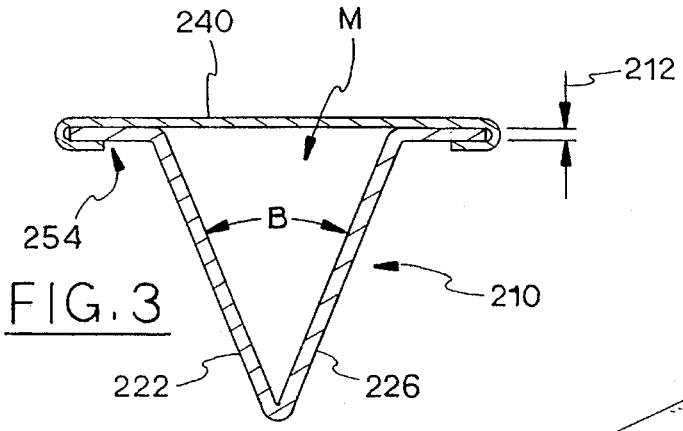
FIG. 3 is an end view of another preferred embodiment of a load-bearing beam according to the invention.

FIG. 3 is a schematic end view of a further preferred embodiment of a beam 210 according to the invention.

Beam 210 has a nominal material thickness 212.

A mouth opening angle B is defined by a left leg 222 and a right leg 226. Angle B is typically 0°–90°.

A cladding 240 surrounds the upper outwardly extending horizontal flanges of a main load-bearing member 214 in a manner similar to that of the preferred embodiment of FIG. 1. An optional weld 254, or series of welds, positively joins cladding 240 to main load-bearing member 214.

Figure 4:
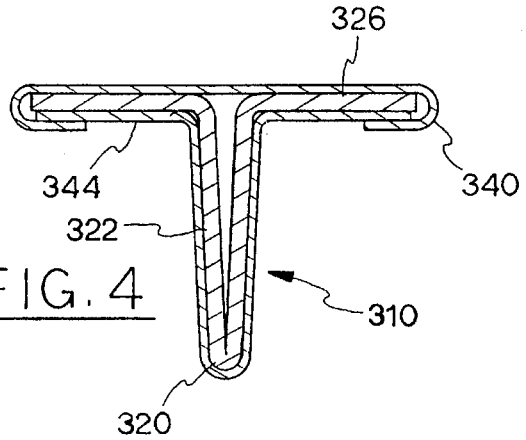
FIG. 4 is an end view of yet another preferred embodiment of a load-bearing beam according to the invention.

FIG. 4 is a schematic end view of another preferred embodiment of a beam 310 according to the invention. Beam 310 is a preferred embodiment of the beam for applications when it is preferable that an entire load-bearing member 320 be clad or encased by sheet stainless steel, for example. An internal angle defined between a left leg 322 and a right leg 326 is preferably in the range of 0°–5°. Upper cladding material 340 may overlap lower cladding material 344, and may be welded together along the free edges thereof, depending on the intended use.

FIGS. 5–8 collectively show several additional preferred embodiments of supports according to the invention that are particularly suited for joining together the different embodiments of the beam according to the invention.

Figure 5:
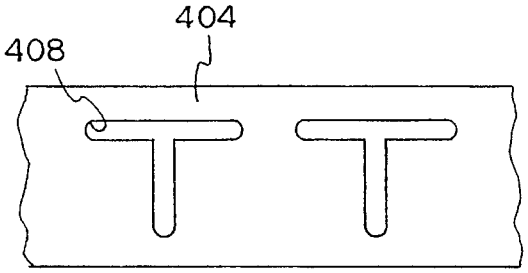
FIG. 5 is a side view of a support member according to the invention prior joining with a beam according to the invention.
Figure 6:
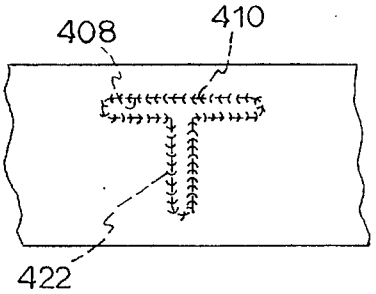
FIG. 6 is a rear view of the support of FIG. 5 after being joined with a beam according to the invention.

FIGS. 5 and 6, specifically, illustrate a support 404 typically a piece of flat steel barstock or sheet stainless steel, through which T-shaped holes 408 have been formed. A free end of a beam according to the invention will be inserted into each of holes 408 and then joined to support 404 to establish a support surface, for example, such as shown in FIG. 2.

A rear view of support 404 is shown in FIG. 6 after a schematically illustrated beam 410 has been inserted and joined to support 404 by a weld 422.

Figure 7:
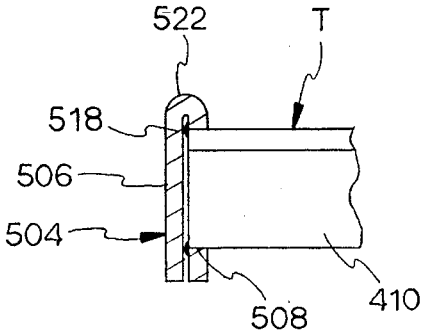
FIG. 7 is a schematic end view of a further embodiment of a support according to the invention after a beam according to the invention has been joined thereto and the support has been folded over to provide a double thickness.

FIG. 7 shows that a preferred embodiment of a support 504 has a longer free leg or extension 506 extending beyond a T-shaped throughhole 508. Accordingly, after beam 410 has been inserted into throughhole 508 and joined thereto by, for example, a weld 518, leg 506 is bent so as to both provide extra strength to support 504 as well as to cover weld 518. The covering of weld 518 is useful when the embodiment of FIG. 7 is placed in environments in which weld 518 would be subject to corrosion, for example. This embodiment is also useful when the intended use benefits from having a free edge 522 spaced from a top surface T of beam 410. In that manner, a lip or stop is provided by the difference in height between free edge 522 and top surface T.

Figure 8:
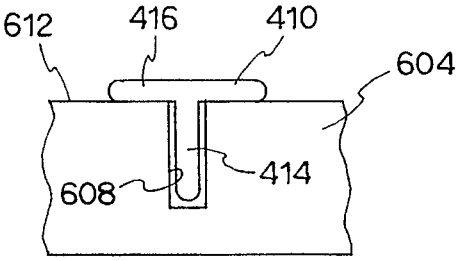
FIG. 8 is yet another embodiment of a support according to the invention joined with a beam according to the invention.

FIG. 8 illustrates a preferred variation in which a support 604 has substantially rectangular cutouts 608 defined therein. Cutouts 608 receive a leg 414 of a typical T-shaped or V-shaped beam 410 having a top support surface member 416. Typically the support surface member 416 will rest on an upper edge 612 of support 604 and be joined thereto such as by welding along free edges thereof, as will be appreciated by a person having ordinary skill in the art.

Figure 10:
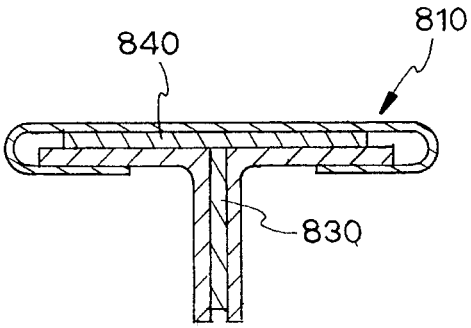
FIG. 10 is yet another preferred embodiment of a beam according to the invention.
Figure 9:
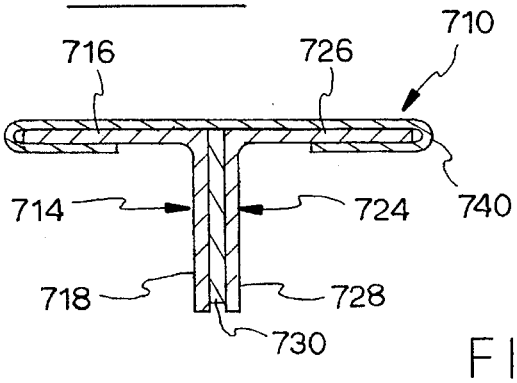
FIG. 9 is an end view of a still further preferred embodiment of a beam according to the invention.

FIGS. 9 and 10 illustrate still further preferred embodiments of a beam according to the invention, in which the beams will generally have end views which are more T-shaped than V-shaped.

A T-shaped beam 710, shown in end view in FIG. 9, preferably includes a left angle member 714 having an upper leg 716 and a lower leg 718. A corresponding right side angle member 724 has an upper leg 726 and a lower leg 728.

To provide additional strength in a cost-effective manner, it is preferred that a thicker structural member, such as insert 730 be sandwiched between left leg 718 and right leg 728. Depending upon the intended use, left leg 718, insert 730, and right leg 728 will be riveted, screwed, glued, or welded together, for example. As in earlier embodiments, it is preferred that a piece of sheet material 740 surround at least left upper leg 716 and right upper leg 726 for enhancing the structural integrity and wear-resistance of beam 710.

Turning to FIG. 10, a preferred embodiment of a beam 810 is similar to the preferred embodiment of the beam of FIG. 9, with the additional feature of a structural member 840 extending transversely to a strengthening element 830.

Figure 11:
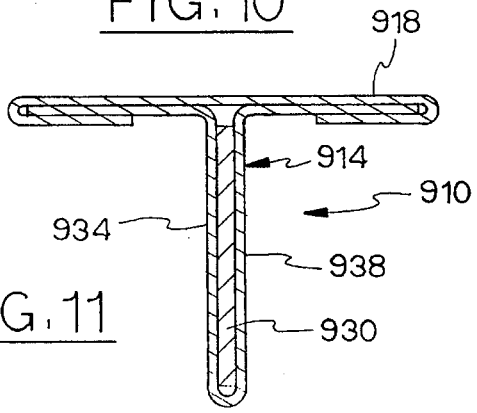
FIG. 11 is an end view of another preferred embodiment of a beam according to the invention.

FIG. 11 illustrates another preferred embodiment of a T-shaped or V-shaped beam 910 according to the invention. Beam 910 includes a lower cladding member 914 and an upper cladding member 918. A structural member 930 is received between left leg 934 and right leg 938. Beam 910 is particularly suited for harsh environments requiring a completely clad structural member 930. Tightly joining each structural element of beam 910 enhances the carrying capacity thereof.

METHOD OF FORMING THE BEAM

In a preferred method of forming beam 10 according to the invention, such as shown in FIG. 1, a roll of flat sheet stock is provided for fabricating main load-bearing member 14, and a roll of flat sheet stock is provided from which cladding 40 is formed.

Preferably, the sheet stock from each roll is concurrently unwound, and routed through appropriate forming dies.

Thus, the left, inwardly extending arm 44 is concurrently formed with and envelops left horizontally extending flange 32. The right inwardly extending arm 48 is likewise formed at the same time as right horizontal flange 36 iS formed, so that all the forming and crimping is carried out substantially simultaneously.

If desired, or required based on the intended use of beam 10, one or more welds 54 are provided along an interface between left arm 44 and left flange 32, for example.

It is likewise contemplated that main load-bearing member 14 will be formed initially, and then cladding 40 will be formed therearound by conventional sheet metal and structural beam forming processes.

The angle defined between the left and right legs of the various embodiments of the invention will typically be in the range of about 0°–135°. Preferably, the angle between the two legs will be in the range of about 0°–90°, and depending on the intended use of the beam, and the length of the legs and other elements, a range of 15–45° has been found to have widespread industrial applicability. In the case of an angle of about 0°, and angles in the range of 0°–5°, in the metal forming trade such small angles would typically be formed from a piece of sheet metal bent 180° over on its self.

In the manufacture of the embodiment of FIG. 9, for example, it is expected that all components will be tightly pressed together, as in many of the other embodiments, and that leg 718, support member 730, and leg 728 will be riveted or welded together.

The support member may be made of steel, the angles may be made of stainless steel or standard carbon steel, and the upper cladding member may be made of stainless steel as the intended application demands.

The embodiment of FIG. 11 will be constructed similar to the construction of the embodiment of FIG. 1, for example, with the addition of a flat shear strip being slid between the cladding member and the V-shaped or T-shaped support, the flat shear strip providing additional support and being attached by riveting or welding, for example. The support will probably be a piece of ¼ inch steel plate for typical applications, and the internal angle will generally be between 0°–5° with all members being tightly joined together so that the flat strip can carry loads.

Depending on the ultimate application to which the beam is subjected, it is contemplated that the free ends of the horizontally extending flanges of the main load-bearing member will be pressing outwardly against an inner face of the respective left and right inwardly extending arms of the cladding so that the cladding is subjected to a predetermined tensile force and the main load-bearing member is subjected to a like predetermined compressive force. The predetermined compressive forces will "preload" the beams.

It is contemplated that the material selected for the main load-bearing member will generally be carbon steel, galvanized steel, painted steel, or stainless steel.

It is likewise expected that the cladding or cladding member will typically be stainless steel, or another rust-resistant material, typically more expensive than the material of the main load-bearing member.

Additional materials contemplated include all generally used construction materials such as plastics, composites, wood, and other clad materials.

Expected ranges of material thicknesses and angles defined between the left and right legs of the main load-bearing member follow. In the case of steel and other typical metal construction materials, the supporting member of the beams will typically be made of coil, sheet, or plate material in the range of 1/64 inch–1½ inch. Support members greater than 1½ inch thickness will typically be made of cast steel.

In use, the load-bearing beam according to the invention has been found particularly well suited for the food processing industry, such as in delicatessens and kitchens, in which hygienic surfaces are often required. Thus, it is expected that the lower load-bearing, main load-bearing member will be fabricated from materials which are less expensive while the upper surface defined by the cladding will generally be made of more expensive materials which resist rust and corrosion.

Successful results have been achieved when the beam was constructed having a stainless steel cladding and a galvanized steel main load-bearing member.

As needed, spot welding, butt welding and continuous welding are used.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. A beam comprising:

a) a substantially V-shaped main load-bearing member;

b) said substantially V-shaped main load-bearing member including a left and a right leg;

c) a left flange disposed on said left leg and extending outwardly therefrom;

d) a right flange disposed on said right leg and extending outwardly therefrom;

e) an apex defined by said V-shaped main load-bearing member;

f) said apex joining said left and said right;

g) a mouth defined by said V-shaped load-bearing member, said mouth being spaced opposed from said apex; and h) a cladding member disposed on said V-shaped main load-bearing member, defining a support surface, and substantially covering said mouth.

2. A beam as defined in claim 1, wherein:

a) said left flange is disposed in the vicinity of said mouth.

3. A beam as defined in claim 1, wherein:

a) said right flange is disposed in the vicinity of said mouth.

4. A beam as defined in claim 1, wherein:

a) said cladding member is a stainless steel.

5. A beam as defined in claim 1, wherein:

a) said V-shaped main load-bearing member is a carbon steel.

6. A beam comprising:

a) a substantially T-shaped main load-bearing member;

b) said T-shaped load-bearing member including a left leg and a right leg;

c) a left flange disposed on said left leg and extending outwardly therefrom;

d) a right flange disposed on said right leg and extending outwardly therefrom;

e) a structural load-bearing member being separate from and disposed between said left leg and said right leg; and f) a cladding member disposed on said T-shaped main load-bearing member, defining a support surface, and substantially covering said left flange and said right flange.

7. A beam as defined in claim 6, wherein a) said cladding member is a stainless steel.

8. A beam as defined in claim 6, wherein:

a) a said T-shaped main load-bearing member is a carbon steel.

9. A beam as defined in claim 6, wherein:

a) a lower cladding member is disposed on and substantially covers said left leg and right leg.

10. A beam comprising:

a) a substantially V-shaped main load-bearing member;

b) said substantially V-shaped main load-bearing member including a left and a right leg;

c) a left flange disposed on said left leg and extending outwardly therefrom; and d) a right flange disposed on said right leg and extending outwardly therefrom;

e) an apex defined by said V-shaped main load-bearing member;

f) a mouth defined by said V-shaped load-bearing member, said mouth being spaced opposed from said apex;

g) a cladding member disposed on said V-shaped main load-bearing member, defining a support surface, and substantially covering said mouth; and h) said cladding member extending over only a portion of said left and right flanges.

11. A beam as defined in claim 10, wherein:

a) said main load-bearing member is made of a first material; and, b) said cladding member is made of a second material.

12. A beam as defined in claim 11, wherein:

a) said first material is a carbon steel.

13. A beam as defined in claim 12, wherein:

a) said second material is a stainless steel.

14. A beam as defined in claim 11, wherein:

a) said second material is a stainless steel.

15. A beam as defined in claim 10, wherein:

a) said apex is substantially closed.

16. A beam as defined in claim 6, wherein:

a) said left leg is integrally attached to said right leg.

17. A beam as defined in claim 6, wherein:

a) said left leg and said right leg are a single piece of material.

18. A beam as defined in claim 6, wherein:

a) said left leg, said left flange, said right leg, and said right flange all are a single piece of material.

19. A beam as defined in claim 1, wherein:

a) said cladding member extends over only a portion of said left and right flanges.

20. A beam as defined in claim 1, wherein:

a) said cladding member is attached to at least one of said left and right flanges.

* * * * *